US008656574B2

(12) United States Patent
Frenken

(10) Patent No.: US 8,656,574 B2
(45) Date of Patent: Feb. 25, 2014

(54) HYDRAULICALLY DRIVEN PRESSING DEVICE AND METHOD OF PRESSING A FITTING

(75) Inventor: Egbert Frenken, Heinsberg (DE)

(73) Assignee: Gustav Klauke GmbH (DE)

( * ) Notice: Subject to any disclaimer, the term of this patent is extended or adjusted under 35 U.S.C. 154(b) by 98 days.

(21) Appl. No.: 13/309,212

(22) Filed: Dec. 1, 2011

(65) Prior Publication Data

US 2012/0073112 A1 Mar. 29, 2012

Related U.S. Application Data

(62) Division of application No. 12/161,769, filed as application No. PCT/EP2007/050582 on Jan. 22, 2007, now Pat. No. 8,245,561.

(30) Foreign Application Priority Data

Jan. 23, 2006 (DE) ..... 10 2006 003 044

(51) Int. Cl.
*B21D 39/00* (2006.01)
*B21J 9/18* (2006.01)

(52) U.S. Cl.
USPC ..... 29/508; 72/453.18

(58) Field of Classification Search
USPC ..... 29/525, 505, 506, 508, 514, 428, 29/407.08, 237, 270, 268, 243.53, 751; 72/409.01, 409.1, 453.16, 453.18, 413
See application file for complete search history.

(56) References Cited

U.S. PATENT DOCUMENTS

| | | | |
|---|---|---|---|
| 3,035,627 | A | 5/1962 | Mark |
| 4,212,185 | A | 7/1980 | Miller |
| 4,345,453 | A | 8/1982 | Lillbacka |
| 4,571,975 | A | 2/1986 | Pawloski et al. |
| 4,796,461 | A | 1/1989 | Mead |
| 5,253,554 | A | 10/1993 | Riera et al. |
| 6,044,681 | A | 4/2000 | Frenken |
| 6,276,186 | B1 | 8/2001 | Frenken |
| 6,718,870 | B1 | 4/2004 | Frenken |
| 7,337,514 | B2 | 3/2008 | McKay |
| 7,788,779 | B2 | 9/2010 | Frenken |
| 2003/0126905 | A1 | 7/2003 | Frenken |
| 2010/0275672 | A1 | 11/2010 | Frenken |

FOREIGN PATENT DOCUMENTS

| | | |
|---|---|---|
| DE | 25 59 674 | 6/1977 |
| DE | 198 03 536 | 9/1998 |
| DE | 198 25 160 | 4/1999 |
| DE | 100 10 601 | 4/2001 |
| DE | 20202200 | 6/2003 |
| DE | 20202200 U1 | 7/2003 |
| EP | 0 908 657 | 4/1999 |
| JP | 45-31054 | 11/1970 |

(Continued)

*Primary Examiner* — John C Hong
(74) *Attorney, Agent, or Firm* — Klintworth & Rozenblat IP LLC

(57) ABSTRACT

A method of using a hydraulically driven pressing device for pressing a fitting on a tube is provided. The pressing device includes a piston and a cylinder for acting on pressing jaws. A piston shaft is connected to rollers. The pressing device can be used to carry out pressing operations requiring different levels of pressing power, by using an adjustable stop which is provided in the direction of displacement of the piston in order to achieve different end positions for the piston during the piston return stroke.

11 Claims, 15 Drawing Sheets

(56) References Cited

FOREIGN PATENT DOCUMENTS

| | | |
|---|---|---|
| JP | 06-32875 | 5/1994 |
| JP | B-H06-32875 | 5/1994 |
| JP | 2595302 | 3/1999 |
| JP | Y-2595302 | 3/1999 |
| JP | 02-178062 | 6/2002 |
| JP | A-2002-178062 | 6/2002 |
| JP | 03-239912 | 8/2003 |
| WO | 2004/081377 | 9/2004 |
| WO | 2007/082951 | 7/2007 |

HYDRAULICALLY DRIVEN PRESSING DEVICE AND METHOD OF PRESSING A FITTING

This application is a divisional application of U.S. Ser. No. 12/161,769 granted a 35 U.S.C. 371 date of Sep. 8, 2008, which is a National Phase filing of PCT/EP2007/050582, having an International filing date of Jan. 22, 2007 which disclosures are herein incorporated by reference.

FIELD OF THE INVENTION

The invention relates, in first instance, to a hydraulically driven pressing device comprising a piston and a cylinder for acting on pressing jaws, at least the piston shank being connected to means of action.

BACKGROUND OF THE INVENTION

Pressing devices of the type in question are known. Reference is thus made, for example, to DE 19803536 A1. This document describes and illustrates a pressing device which has via tong-like jaws, on a pressing chain with a plurality of chain links. The piston of the pressing device, for the purpose of acting on the pressing jaws, is displaced hydraulically into the pressing position. The return stroke takes place by means of a spring, which is stressed during the forward stroke.

DE 10010601 A1 discloses a pressing device of the type in question in which a pressing mouth, which is formed from the pressing jaws and carries exchangeable pressing inserts, is subjected to hydraulic action.

The action to which the pressing jaws are subjected generally takes place via tool-mounted means of action, which are connected at least to the shank of the hydraulically displaceable piston.

In respect of the above described prior art, a technical problem of the invention is considered that of further improving a pressing device of the type in question such that pressing operations, which require different levels of pressing energy, can be carried out by the same device.

SUMMARY OF THE INVENTION

This problem is solved first and foremost by the subject matter of claim 1, this being based on the fact that an adjustable stop is provided in the displacement direction of the hydraulic piston in order for different end positions of the hydraulic piston to be reached during the return movement of the piston. This configuration provides a pressing device of the type in question by means of which different piston strokes can be executed. It is also the case that the adjustable stop limits the return movement of the piston, in particular once the pressing operation has taken place, so that a subsequent pressing operation takes place from this delimited piston-stop position. This stop adjustment makes it possible to carry out pressing operations with different levels of pressing energy, and this can be done in "just one go", i.e. with just a single actuation of the device. This takes place, more preferably, during continuous ongoing piston movement. Accordingly, it is preferably the case that no unnecessary travel is provided in respect of the piston stroke. If low levels of pressing energy are necessary, then the adjustable stop is moved into a position from which the piston covers a relatively small axial distance for the pressing operation. If high levels of pressing energy are necessary, the stop is accordingly moved into a position from which the piston covers a longer distance until pressing is complete. Accordingly, pressing with different levels of pressing energy can be achieved by one and the same pressing device, different pressing forces being also generally achievable, ultimately governed, in the case of conventional pressing devices, by the pressing-jaw portions interacting with the means of action. However, it is also possible, despite different levels of pressing energy, to achieve the same end force in the maximum pressing position. Increased pressing energy is necessary, for example, for pressing fittings with large nominal widths. The proposed solution still allows conventional standard pressing jaws to be used with the pressing device.

For this purpose, a standard pressing-jaw holder is also provided on the pressing device, that is to say preferably one in which the fork legs of the device neck have, on the surfaces which are directed toward one another and basically consist of parallel planes, a central longitudinal groove running in the displacement direction of the piston. The longitudinal groove preferably likewise has parallel surfaces (groove bases). The width of the groove base is preferably 36.2 to 36.4 mm. The spacing between the groove bases, that is to say in the direction perpendicular to the surfaces forming the groove bases, is preferably 33.1 to 33.3 mm. Furthermore, the pressing jaws can be secured by a bolt which passes through the device necks transversely in relation to the displacement direction of the piston. For this purpose, the pressing jaws have connecting plates containing bores. The diameters of the bores in the connecting plates and/or in the device necks is 14 to 14.1 mm, the bolt diameter being from 13.5 to 13.95 mm.

Of course, it is still possible for the abovementioned dimensions to vary somewhat, as long as the compatibility in respect of the appropriate standard jaws here is maintained.

The critical factor is for it to be possible for both the pressing jaws for pressing with a high level of energy and the standard pressing jaws to be inserted and secured in one and the same pressing-jaw holder, indeed the standard pressing-jaw holder described.

The subjects of the rest of the claims will be explained hereinbelow with reference to the subject matter of claim 1, but may also be important in their independent formulation.

The stop can be adjusted mechanically, for example with hydraulic or electrical assistance. A preferred configuration is one in which the stop can be adjusted by hand, more preferably by a latching means or the like being released prior to displacement, in particular sliding displacement. In a further-preferred configuration, the adjustable stop is provided with two stop positions which can be secured, in particular by latching means. It is quite possible for the stop also to be provided with a number of positions, that is to say the two end positions and further intermediate positions, in order thus to extend the range of the possible piston strokes and, correspondingly, of the levels of pressing energy. Furthermore, it is proposed that the stop can be adjusted by means of a handgrip provided radially outside of the cylinder. The handgrip, correspondingly, is provided in the so-called dry region of the hydraulic arrangement, that is to say radially outside the cylinder which encloses the hydraulically operated piston. The handgrip is thus preferably disposed on the pressing device in a position which is advantageous in handling terms, more preferably in the vicinity of the pressing jaws. The handgrip is preferably formed as a sleeve which can be displaced relative to the cylinder and therefore, more preferably, as a sleeve which encloses the cylinder and which can be gripped by the user if required. This sleeve-like handgrip is provided, for example, with a latching button for deactivating the latching action or the like which secures the stop position. Markings or the like, further, for example, colored markings which indicate the different stop positions, may be provided on the cylinder on which the sleeve can be displaced.

A particularly advantageous configuration has proven to be one in which the stop is also provided outside the cylinder, furthermore, correspondingly, in the so-called dry region remote from where the piston is subjected to hydraulic activation. The stop here preferably interacts with a portion of the piston shank which connects the piston to the means of action. The piston, which interacts with the stop, need not necessarily be the piston of the hydraulic cylinder/piston combination. Rather, it is also conceivable to have an arrangement in which the pressing device has an exchangeable device head with a separate piston shank and restoring spring. Accordingly, in the case of such a configuration, the stop, together with the handgrip, is part of the exchangeable device head, which, as a result of this configuration, can be set to different levels of pressing energy required.

The means of action, which are connected to the piston shank, are rollers which act on facing curved tracks of the pressing levers and/or pressing jaws in order, over the distance covered by the piston, to spread apart the pressing-jaw ends having the curved tracks, thus resulting, at the other ends of the pressing jaws, in the closure of the pressing mouth which is formed there. In a preferred configuration, the stop interacts with these rollers. Correspondingly, during the return movement of the piston, once the pressing operation has taken place, these rollers strike against the stop, and the next pressing operation can be carried out from this position.

Provision is also made for the pressing device to be provided with at least two pairs of different pressing jaws which differ in respect of the length of a region of interaction—the curved track—with the means of action, a relatively long region of interaction being accompanied by a relatively small angle of slope of those surfaces of the regions of interaction which are associated with the means of action. Accordingly, the pressing device can be fitted with pairs of pressing jaws which, while having the same pressing-mouth geometry, in particular differ by the length of the pressing-jaw legs interacting with the means of action or rollers, this being adapted to the piston stroke, which can be set in each case via the adjustable stop. The level of pressing energy is altered by adapting the angle of slope of the curved tracks of the pressing jaws, these curved tracks interacting with the rollers, this with a preferably constant piston-pushing force of, for example, 32 kN. Accordingly, for example for the purpose of pressing fittings with relatively large nominal widths, relatively high levels of pressing energy preferably being desired here, pressing jaws with relatively long pressing-jaw levers are secured to the pressing device, and the stop for the piston is set such that an increased, preferably a maximum, piston stroke is achieved. By virtue of the contact angle of the curved tracks, which interact with the rollers, being shallower, preferably over the entire piston stroke, in relation to the shorter jaws, it is possible to increase the level of pressing energy, preferably with a constant piston-pushing force, different pressing forces in the pressing mouth generally also being achieved. Despite different levels of pressing energy, it is also possible to achieve a constant end force in the pressing mouth.

The preferably stop-limited minimum piston stroke is, for example, 40 mm. The maximum piston stroke preferably corresponds to 1.5 to 3 times the minimum stroke, for example 80 to 100 mm. In the case of a preferably constant piston-pushing force of approximately 32 kN, it is possible to achieve levels of pressing energy of 1000 to 4000 Joule, furthermore, for example, 1280 Joule for a short-stroke pressing operation and 3040 Joule for a long-stroke pressing operation (in each case theoretical values before losses).

The invention further relates to a method of pressing a fitting on a tube by means of a pressing chain and a hydraulic pressing device with a piston/cylinder stroke, the pressing chain having more than two chain links and the pressing operation being carried out with a certain level of pressing energy.

A pressing chain is known from DE 10257613 A1. This pressing chain is operated, for example, by means of a pressing device, for example according to DE 19944229 A1.

In order to improve a method of the type in question, it is proposed for the pressing operation to be carried out by a pressing device for which the level of pressing energy applied during a pressing operation can be changed by adjustment of a fixed stop, against which the piston strikes in order to limit the piston movement, and is set for a certain pressing operation such that the pressing operation is carried out during continuous ongoing piston movement.

As a result of the method proposed, the same pressing device can be used both for pressing fittings with a low level of pressing energy and for pressing fittings with a higher level of pressing energy. This provides the pressing device with different piston strokes which the piston can execute in full following single actuation of the device (actuation "in one go"). The adjustable fixed stop limits the return movement of the piston, in particular once the pressing operation has taken place, but possibly also as a result of user intervention, so that a following pressing operation takes place from this limited piston-stop position. If low levels of pressing energy are necessary, the adjustable stop is moved into a position from which the piston covers a relatively small axial distance for the pressing operation. If high levels of pressing energy are necessary, correspondingly, the stop is moved into a position from which the piston covers a longer distance until pressing is complete. Irrespective of the levels of pressing energy, which can be set differently via the alterable fixed stop, and associated different piston strokes, the piston-pushing force is preferably constant. It is quite possible here to achieve generally different pressing forces in the pressing mouth. Increased pressing energy is necessary, for example, for pressing fittings with large nominal widths.

DESCRIPTION OF THE DRAWINGS

The invention will be explained in more detail hereinbelow with reference to the accompanying drawing, which merely illustrates exemplary embodiments and in which.

DETAILED DESCRIPTION OF THE ILLUSTRATED EMBODIMENT

Figure 1:
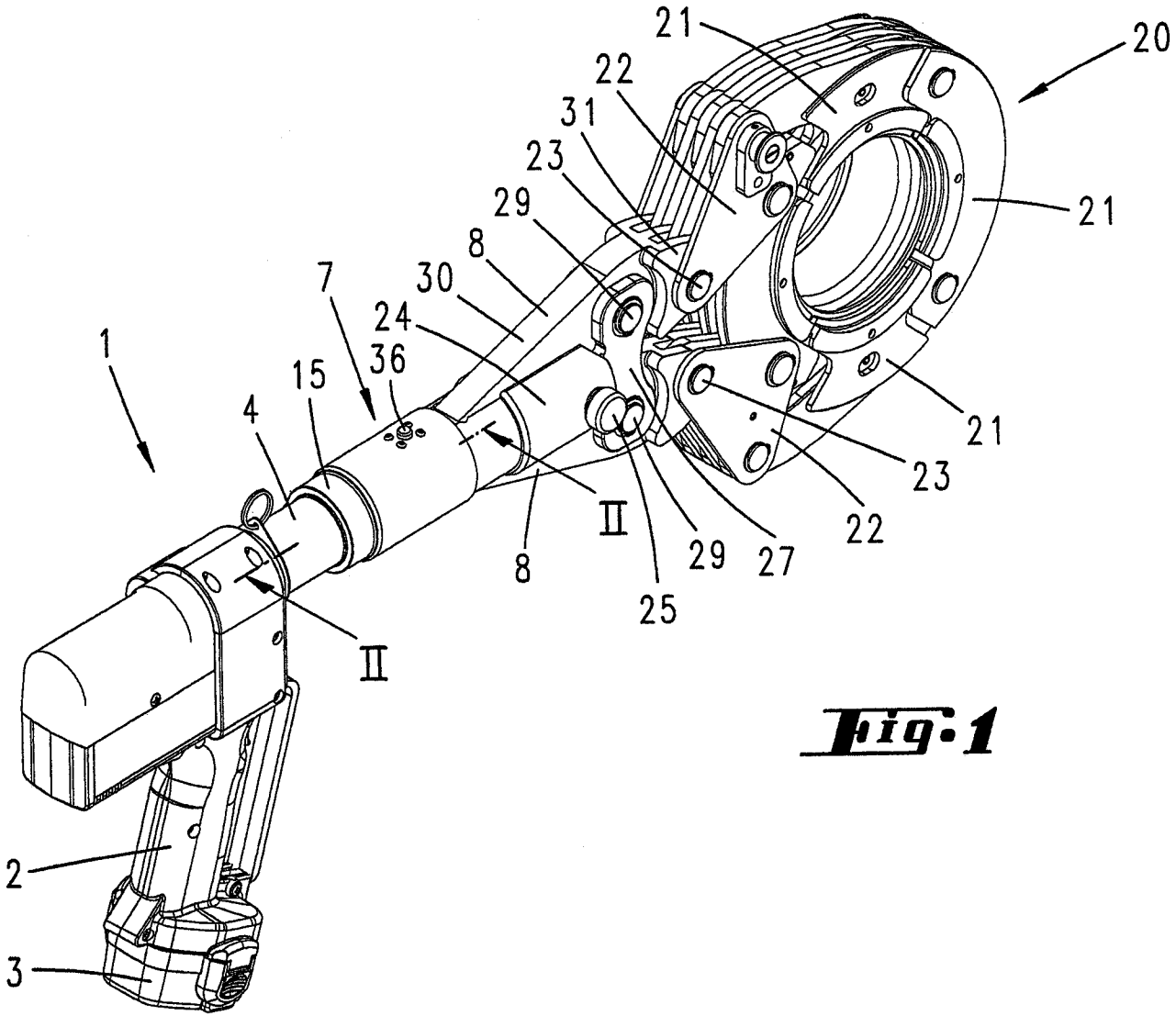
FIG. 1 shows a perspective illustration of a first embodiment of a pressing device, with pressing jaws acting on a pressing chain.
Figure 2:
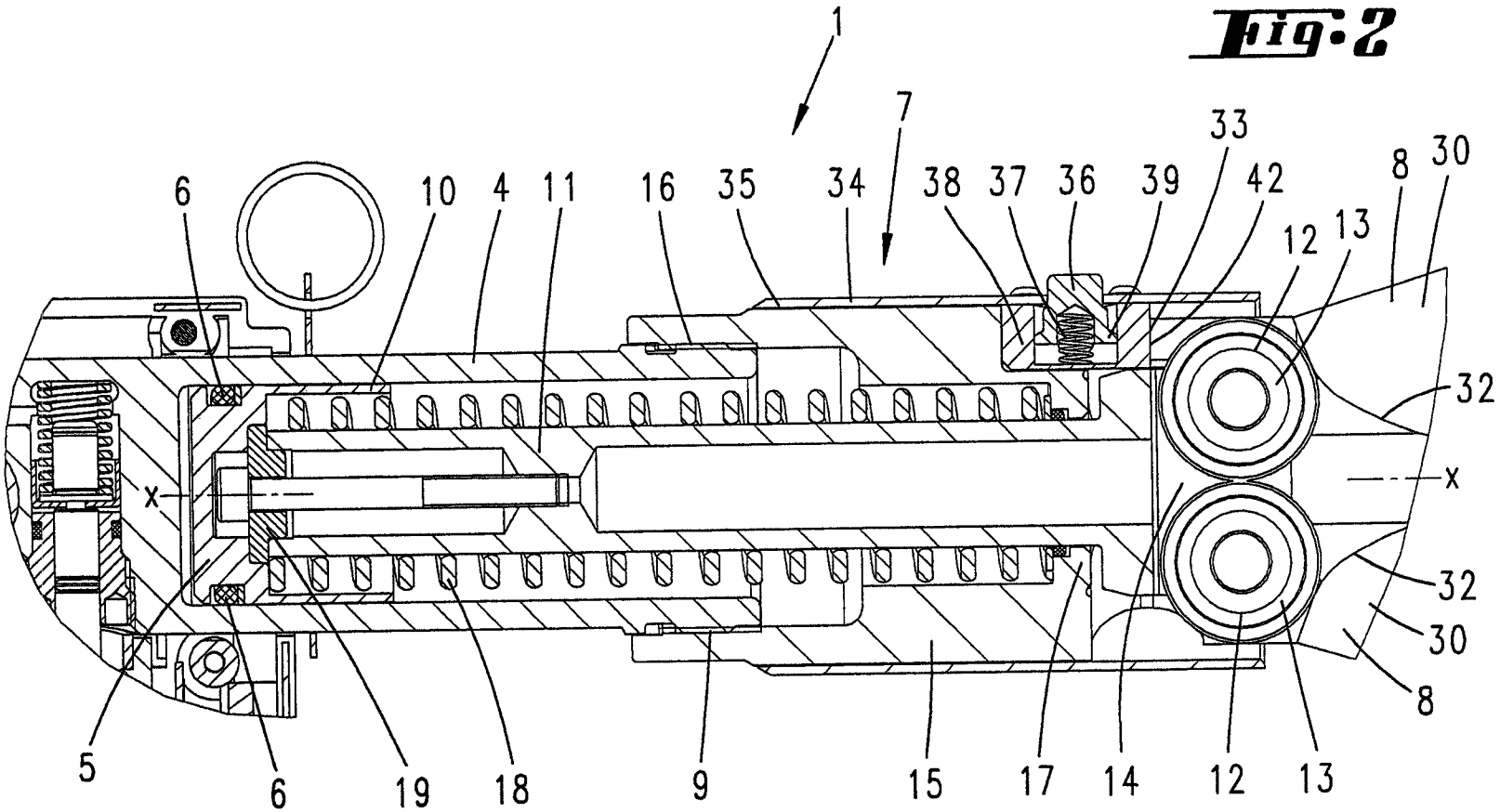
FIG. 2 shows the section along line II-II in FIG. 1, relating to a long-stroke position of the tool.
Figure 3:
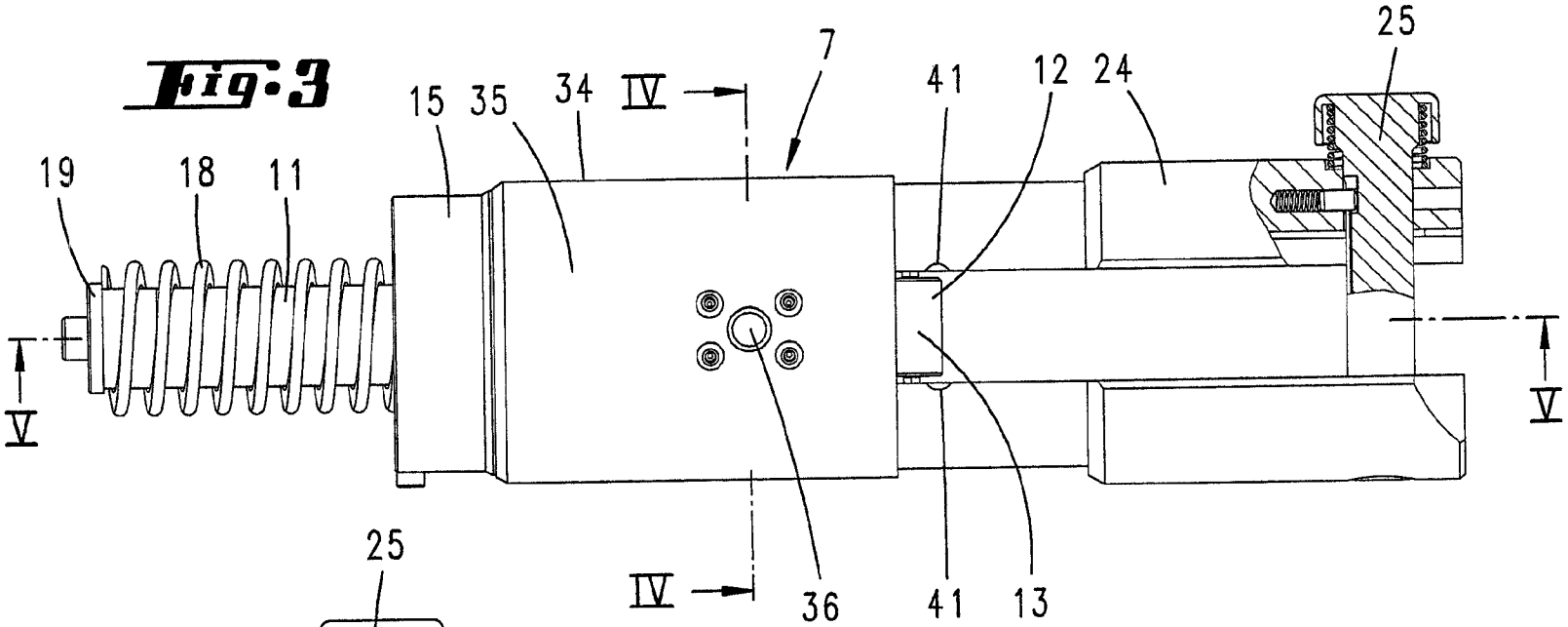
FIG. 3 shows an illustration solely of the exchangeable device head of the pressing device, likewise relating to the long-stroke position.
Figure 4:
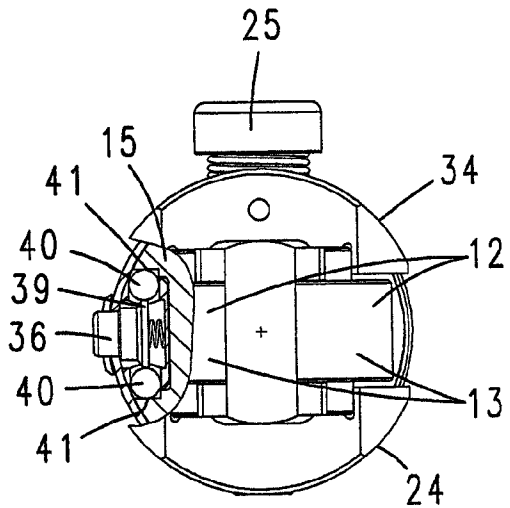
FIG. 4 shows the section along line IV-IV in FIG. 3.
Figure 5:
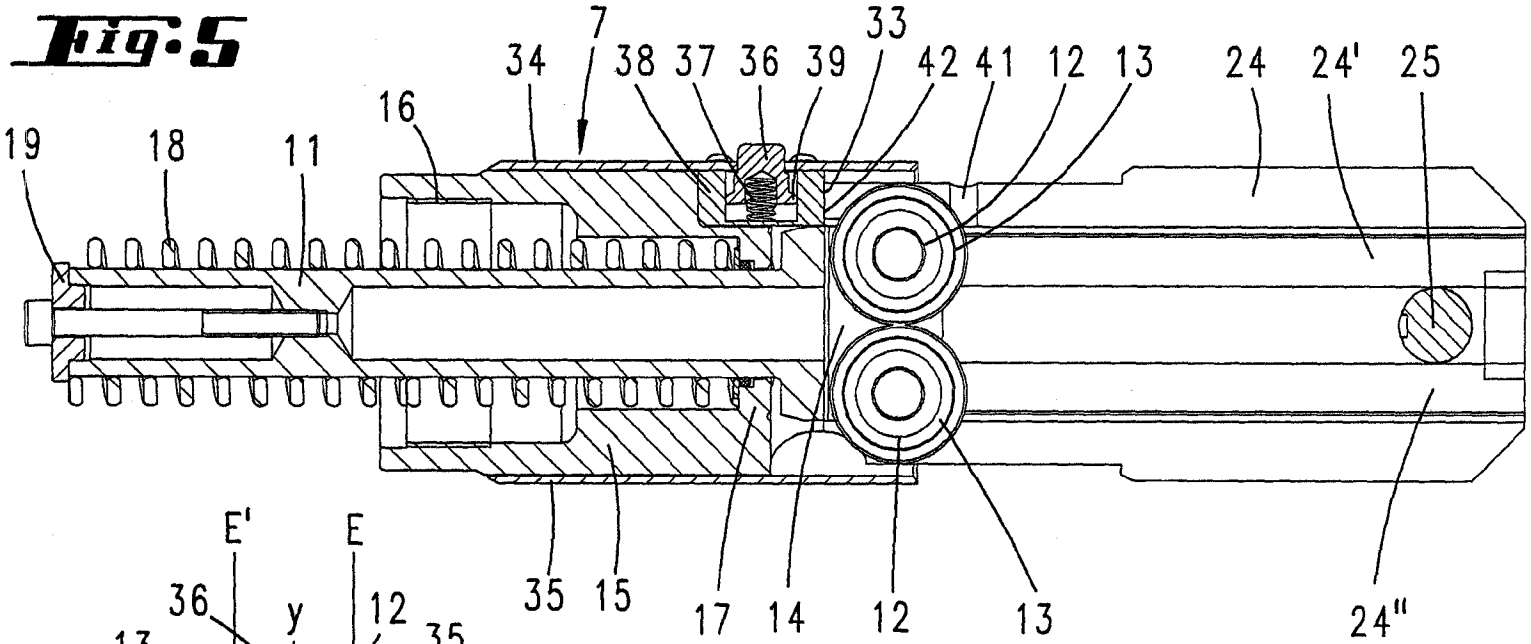
FIG. 5 shows the section along line V-V in FIG. 3.

Illustrated and described, in the first instance with reference to FIG. 1, is a first embodiment of a hydraulic pressing device 1 which is operated by an electric motor. Such a tool is known from DE 19944229 A1. The content of this patent application is hereby also included in full in the disclosure of the present invention, also for the purpose of incorporating features of this patent application in claims of the present invention.

An electric motor is disposed in the device 1. This electric motor is driven via a storage battery integrated in a handle 2. Upon actuation of a finger-actuable switch in the region of the handle 2, oil is pumped out of a supply chamber into a cylinder 4, as a result of which a piston 5 is moved in the direction of its operating end position.

In the exemplary embodiment illustrated, an exchangeable device head 7 is disposed on the hydraulic cylinder 4, which encloses the piston 5, the piston being provided with a radial seal 6. This device head 7, which is shown in the illustrations, serves for accommodating activatable pressing jaws 8.

The substantially cup-like hydraulic cylinder 4 is formed so as to be open in the direction towards the device head 7, and it serves on the one hand, on its inner wall, for guiding the piston 5 and on the other hand, on its outer wall, for connecting the pressing device 1 to the device head 7, for which purpose the hydraulic cylinder 4 has an external thread 9 on its outer wall.

The piston 5 is of cup-like configuration, with a coaxially oriented cup wall 10, the outer wall of which is supported on the inner wall of the hydraulic cylinder 4.

The cup wall 10 encloses a piston shank 11, which is seated on the piston 5, at a radial spacing from the cup wall, the piston shank 11, at its other end, being a carrier for means of action 12 which serve for interacting with the pressing jaws. These means of action are formed as rollers 13.

Two such rollers 13 are provided on a carrier 14 at the end of the shank. The rollers 13 are secured in a rotatable manner on the carrier 14, the arrangement further being selected such that the rollers 13 are disposed one beside the other on either side of a longitudinal axis x of the piston shank.

The device head 7 is fixed to the pressing device 1 by means of a cylinder portion 15 which, in order to interact with the external thread 9, is provided with an internal thread 16. The cylinder portion 15 forms, in the radially inward direction, a stop wall 17, through which the piston shank 11 passes. The stop wall 17 serves for supporting the one end of a cylinder compression spring 18, which encloses the piston shank 11 and the other end of which, enclosed by the cup wall 10, acts on the piston 5 via a centering protrusion 19 on the piston shank. The centering protrusion 19 is seated in a facing depression in the piston 5.

In the embodiments illustrated, the means of action 12 act on pressing jaws 8 which serve for pressing a fitting by means of a pressing chain. Use is made, in this respect, in particular of a pressing chain as is known from DE 10257613 A1. The content of this patent application is hereby also included in full in the disclosure of the present invention, also for the purpose of incorporating features of this patent application in claims of the present invention.

The pressing chain 20 has a total of four pressing links 21, which are jointly involved in the pressing operation.

The pressing jaws 8 act on the pressing chain 20 via articulation levers 22 on the chain. These articulation levers are provided with force-introduction elements 23 in the form of bolts. These bolts form bearings and counter-bearings for acting on the pressing chain 20.

The pressing jaws 8 are secured in an exchangeable manner on the device head 7. For this purpose, the latter has a device neck 24. This is of fork-like configuration, with a bolt holder, which passes through the fork legs transversely to the extent of the neck and in which a locking bolt 25 is secured.

The locking bolt 25 passes through, on the device, the fork legs of the device neck 24 and, on the tool, correspondingly positioned securing apertures 26, which are formed in fastening plates 27.

The fastening plates 27 penetrate into the fork region of the device neck 24 by way of their portions which contain the securing openings 26.

The fastening plates 27 are of T-shaped configuration in plan view, the central T-leg containing the above-described securing opening 26 and the T-crossbars, which are oriented transversely to the T-leg, containing accommodating bores 28 in each case.

The pressing jaws 8 are secured in a pivotable manner between the two fastening plates 27, for which purpose pivot pins 29, which are held on either side in the accommodating bores 28 of the fastening plates 27, pass through the pressing jaws 8.

The pivot axes extend, on either side, perpendicularly to the longitudinal axis x of the piston shank.

In respect of those parts of the device neck 24 which are formed for mounting the pressing jaws 8, and of the corresponding adapter parts on the pressing jaws, that is to say in particular the abovementioned fastening plates 27, the pressing jaws are formed in accordance with a standard.

Figure 6:
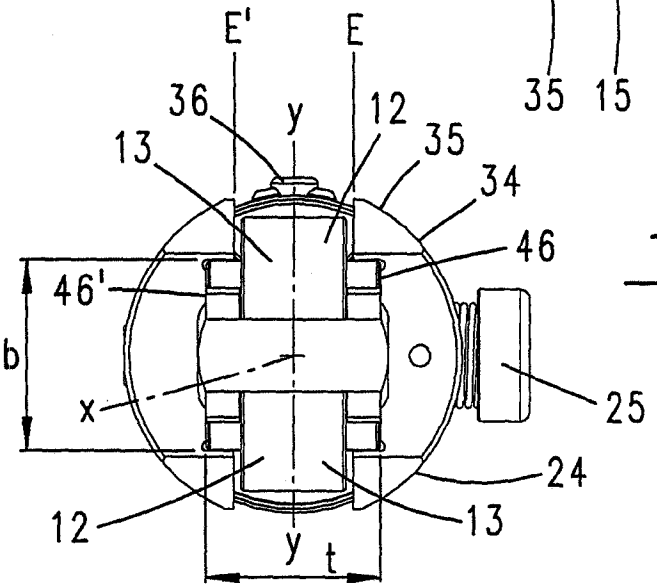
FIG. 6 shows the end view of the exchangeable device head.

For this purpose, it is specifically provided that the fork arms 24' and 24" of the device neck 24 have two planes E and E' which are located opposite one another and parallel to one another, and, in turn, have longitudinal grooves 46, 46' which are set back symmetrically (as are the planes E and E' themselves) in relation to a transverse axis y-y (cf. FIG. 6), as seen in cross section, and have groove bases which, in turn, have surfaces located opposite one another and substantially parallel to one another. The transverse spacing t between the groove bases is here preferably 33.1 to 33.3 mm for the standard design selected. The width b of the groove 46, 46' is preferably 36.2 to 36.4 mm.

Figure 12:
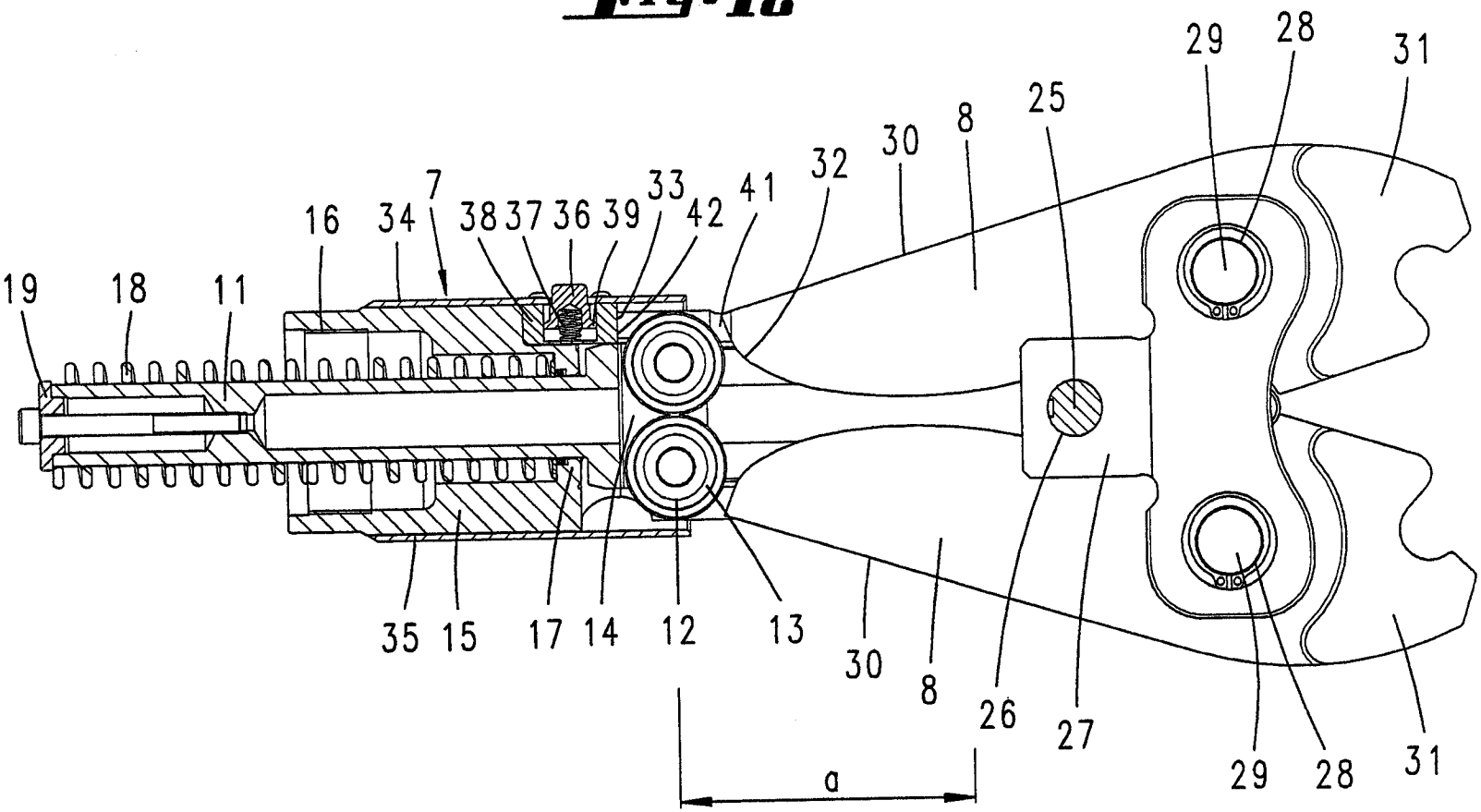
FIG. 12 shows the longitudinal section through the pressing device in the long-stroke position with corresponding relatively long pressing jaws for acting on a pressing chain.

The pressing jaws are secured in the holder by means of a bolt 25, which passes through the fork legs 24' and 24" and also passes through the securing apertures 26 in the fastening plates 27 (cf. also FIG. 12).

In the standard design selected, the bolt here has a diameter of 13.5 to 13.95 mm, while the abovementioned bores have a diameter of 14 to 14.1 mm.

The pressing jaws 8 are formed in the manner of levers and, on account of the above-described articulation of the fastening plates 27, are positioned in the manner of tongs, one lever portion of each pressing jaw 8 forming a control lever 30 and the portion which projects, in extension of this control lever 30, beyond the region of the fastening plates 27 forming a tong-jaw-like active portion 31. These portions are provided with suitable holders for the force-introduction elements 23 of the pressing chain 20, for example with open-periphery recesses and/or bores for accommodating these bolts.

Starting from the fastening plates 27, the control levers 30 extend in the direction of the means of action 12 of the device and, in the direction towards these means of action, that is to say on the narrow sides which are directed toward one another, they form curve-like control surfaces 32, along which the roller-form means of action 12 run during piston advancement.

Upon actuation of the pressing device 1, oil is pumped into a pressure chamber, as a result of which the piston 5 is moved, counter to the action of the return compression spring 18, in the direction of its operating end position, that is to say in the direction of the pressing jaws 8.

The means of action 12 or rollers 13, which engage against the control surfaces 32 of the pressing jaws 8, here cause the control-lever portions 30 of the pressing jaws 8 to be pivoted, on account of the selected angles of slope of the control surfaces 32, and, accordingly, via the pivot axes, the active portions 31 at the ends of the pressing jaws 8 are moved toward one another. Via the articulation levers 22, this causes the pressing chain 20 to be closed and, accordingly, a fitting to be pressed by means of the pressing links 21.

The return movement of the piston 5 takes place via the restoring compression spring 18 as soon as a return-flow valve (not illustrated), opens on account of a predetermined maximum pressure being exceeded. Reference is made, in this respect, to DE 19825160 A1. The content of this patent application is hereby also included in full in the disclosure of the present invention, also for the purpose of incorporating features of this patent application in the claims of the present invention.

The outlet valve is opened automatically when a maximum pressure to which the fitting is subjected is exceeded, whereupon the piston 5 moves back, in the first instance automatically, under the action of the compression spring. The outlet valve closes automatically as soon as the pressure to which the oil is subjected by the returning piston 5 drops as a result of the piston coming to a standstill.

When the pressing operation has taken place, the piston 5 moves back with spring assistance, as a result of the valve opening and the resulting drop in pressure on the part of the hydraulics, into a piston rest position, which is achieved with stop limiting.

Starting from this piston rest position, upon renewed activation, the piston 5 moves over a predefined path until the maximum pressure is reached or exceeded. With constant piston-pushing force of preferably 32 kN, altering the extent of this path makes is possible to vary the level of pressing energy which is to be applied.

For this purpose, the stop which defines the piston rest position can be adjusted, as a result of which the extent of the path covered by the piston can be altered to match the level of pressing energy desired.

An adjustable stop 33 is provided outside the hydraulic region, that is to say on the dry side of the piston 5, in specific terms, in the exemplary embodiment illustrated, in the region of the removable device head 7. This stop is formed on the inner wall of a sleeve 34 which encloses the cylinder portion 15 of the removable device head 7.

This sleeve 34 is secured on the cylinder portion 15 such that is can be displaced along the axial extent of the piston shank 11, the axial displacement of the sleeve 34 in both directions being stop-limited, and the two stop-limited end positions, at the same time, defining the two positions for the adjustable stop 33.

The sleeve 34, which also forms the handgrip 35, has a preferably thumb-actuable push button 36. This is biased in the radially outward direction, on the underside, by a compression spring 37.

The push button 36 is accommodated in a stop housing 38, which is disposed on the inner wall of the sleeve 34, and the compression spring 37 is supported on the stop housing base accommodating the push button 36.

The active portion of the push button 36, this portion being accommodated in the stop housing 38, has a radially widened collar 39. The collar acts on latching balls 40 which are disposed on either side of the push button 36, in a plane transverse to the extent of the longitudinal axis, and, when displaced outward beyond the collar 39, enter into correspondingly positioned latching-ball holders 41 of the cylinder portion 15 on the device head. This latching engagement forms the abovementioned securable end stop for the sleeve 34.

Figures 9, 10:
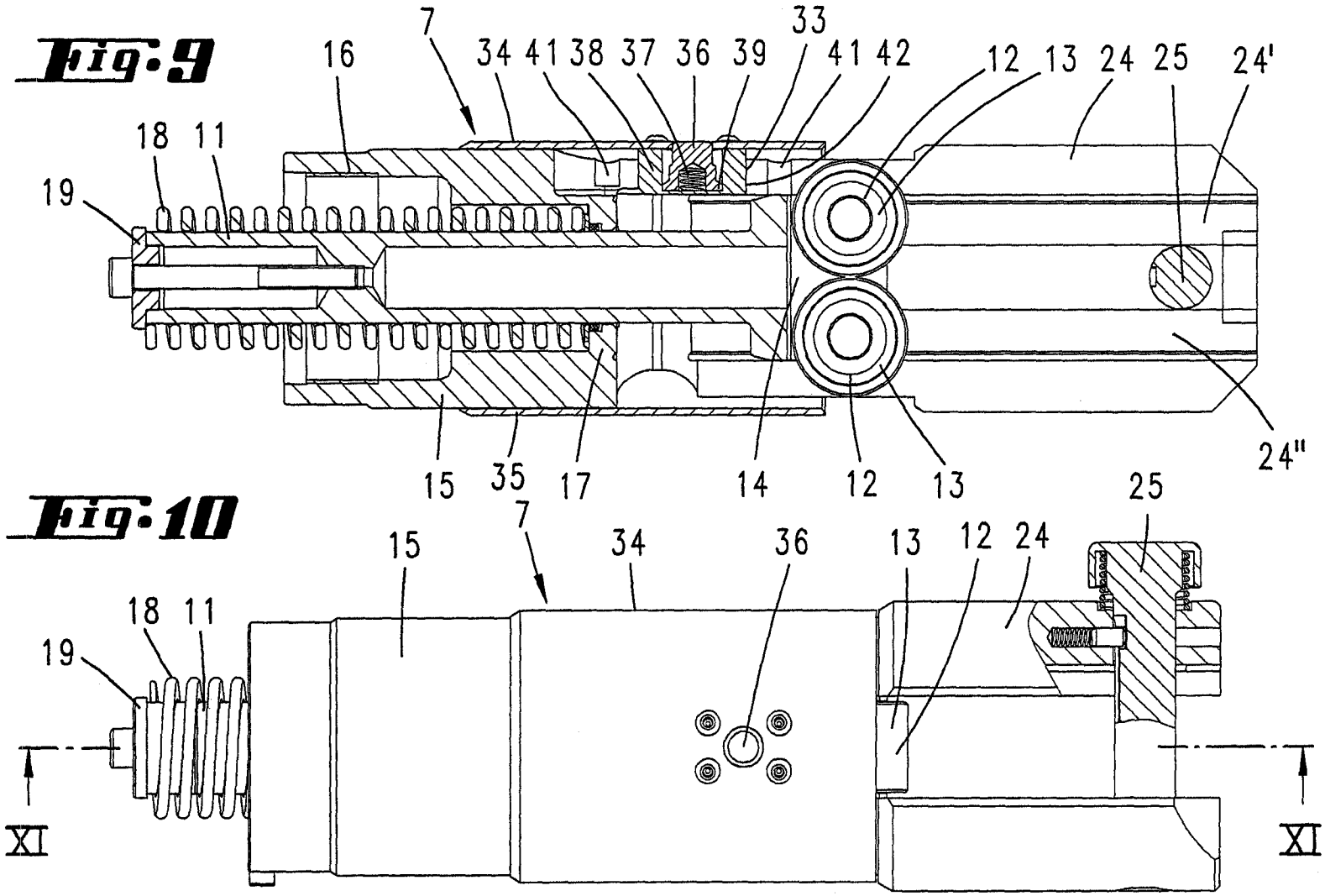
FIG. 9 shows the section along line IX-IX in FIG. 7.
FIG. 10 shows an illustration corresponding to FIG. 3, but this time relating to the short-stroke position following displacement of the stop.
Figure 11:
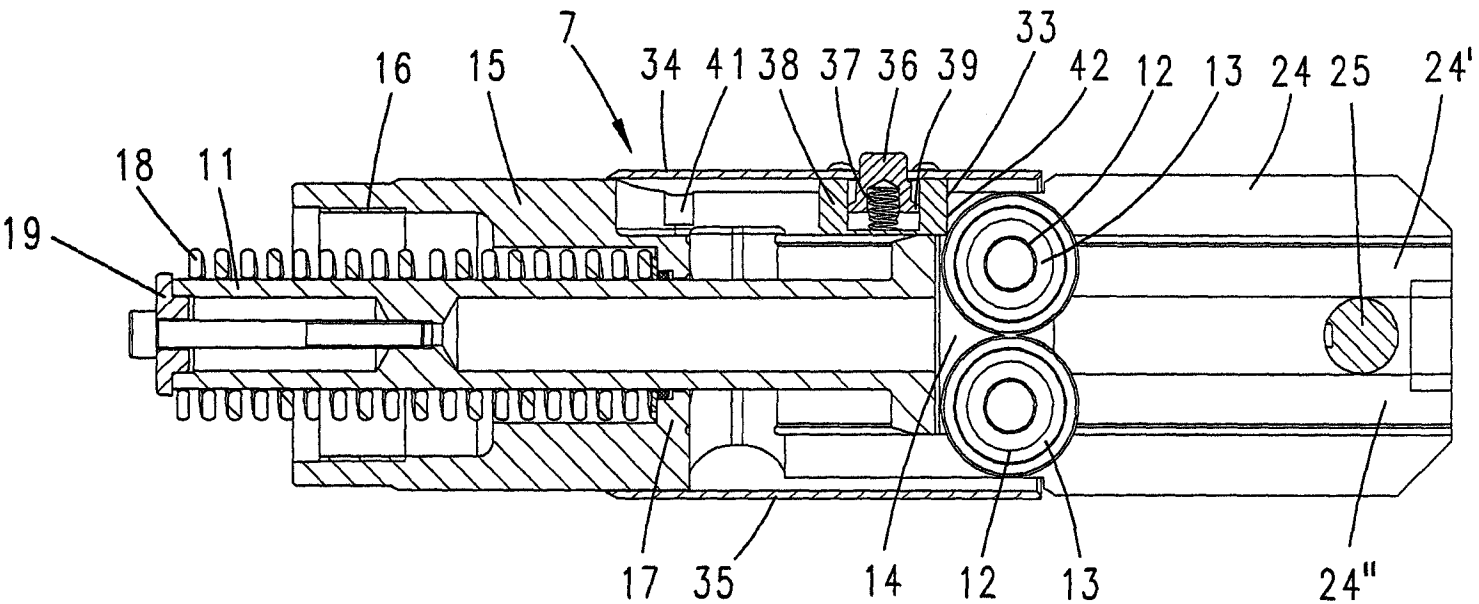
FIG. 11 shows the section along line XI-XI in FIG. 10.

In the exemplary embodiment illustrated, two positions of the sleeve 34 can be secured by latching means, thus, on the one hand, an axially rearward position according to FIGS. 2 to 5, and a forward position according to FIGS. 10 and 11.

Figure 7:
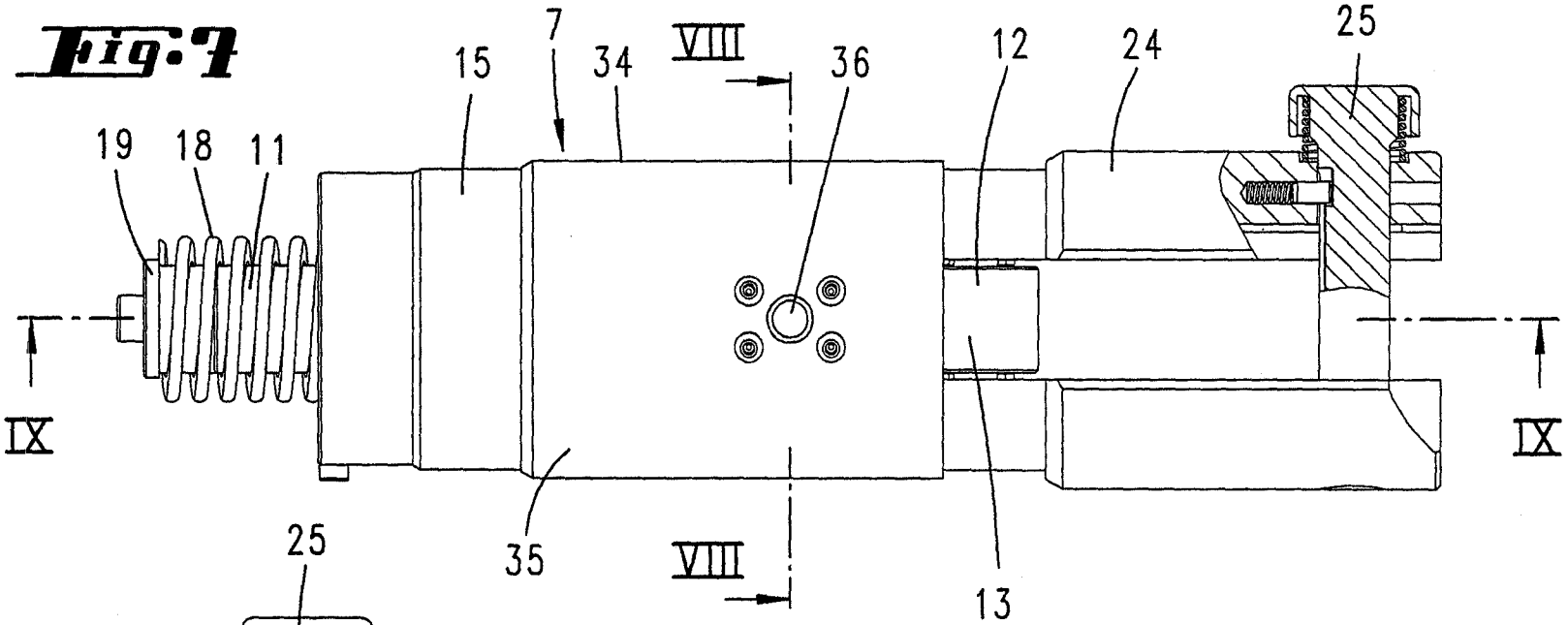
FIG. 7 shows an illustration corresponding to FIG. 3, but this time relating to an intermediate position during the displacement of a stop.
Figure 8:
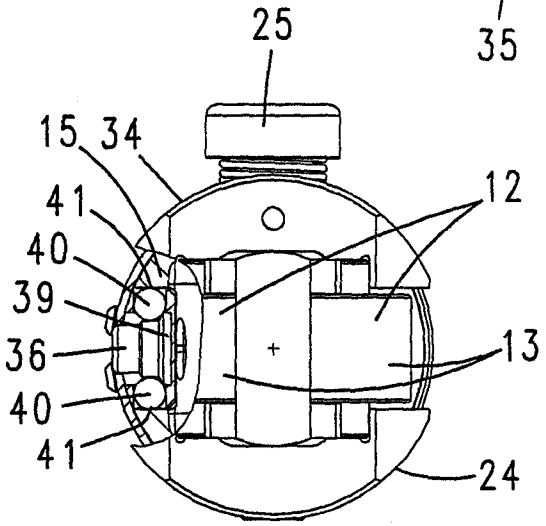
FIG. 8 shows the section along line VIII-VIII in FIG. 7.

FIGS. 7 to 9 show an intermediate position of the sleeve 34 in which the latter has not been secured by latching means.

The end surface 42 of the stop housing 38, this end surface being oriented in the direction of the means of action 12, forms the adjustable stop 33.

Figure 13:
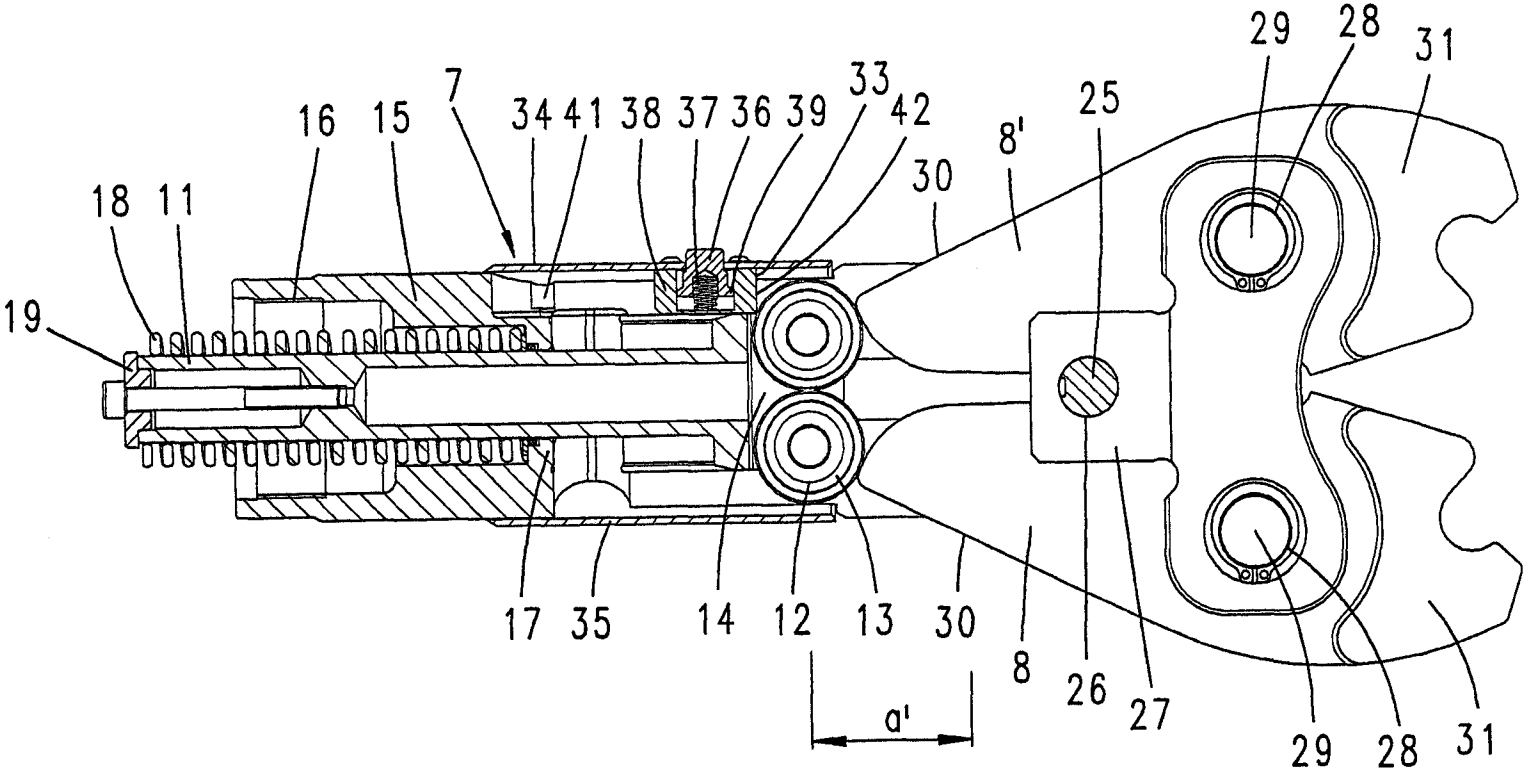
FIG. 13 shows an illustration corresponding to FIG. 12, but this time relating to the short-stroke position, with shorter pressing jaws.

In the rearward latching position of the sleeve 34, this position producing a relatively long piston stroke a, the piston 5 engages in a conventional manner, with stop-limiting action, in the piston rest position against the base of the hydraulic cylinder 4, which accommodates the piston 5. From this position, according to FIGS. 2 to 6, the piston 5 moves over its maximum displacement path, while applying a maximum level of pressing energy of approximately 2500 to 3200 Joule. Corresponding to the rearward stop position of the piston 5, it is also the case that the means of action 12, which interact with the piston 5 via the piston shank 11, are retained in a rearward position. Correspondingly, in such a configuration, use should be made of pressing jaws 8 which are adapted, in respect of the length of the control levers 30, to the spacing between the means of action 12 and the points at which the pressing jaws are secured in the region of the locking bolt in the device neck, it being possible for this spacing to be varied via the adjustable stop 33. Thus, in a configuration with a long piston stroke, pressing jaws according to FIG. 12 are provided, these having control levers 30 which are extended in length compared with those of the pressing jaws 8' in FIG. 13 and have correspondingly longer control surfaces 32.

If there is no need for high levels of pressing energy (for example 1000 to 1500 Joule), then the piston rest position is advanced in the direction of the forward movement of the piston, and this results in shortening of the piston stroke a' during a pressing operation. For this purpose, the adjustable stop 33 is advanced in the forward direction of the piston via the sleeve 34, following prior release of the latching means via the push button 36. This is done until the corresponding end position, in which the latching means provided engages again, is reached.

This sleeve advancement for adjusting the stop 33 into the short-stroke position preferably takes place during a previous pressing operation or during corresponding piston advancement, in order thus to provide corresponding forward movement of the means of action 12 ahead of the stop 33 which is to be adjusted. Such an intermediate position is illustrated, for example, in FIG. 9, albeit, in this case, without the device head 7 being connected to the pressing device 1. The intermediate position illustrated can only be reached with the piston shank being influenced via the hydraulic piston/cylinder arrangement.

In the forward position of the stop 33, which is shown in FIGS. 10 and 11, one of the means of action 12, or one of the rollers 13, engages against the end surface 42 of the stop housing 38 once a maximum pressure has been exceeded, or possibly as a result of intervention by the user, during the return movement of the piston, as a result of which a standstill state is achieved via the carrier 14 and the piston shank 11, counter to the action of the force of the compression spring 18 acting on the centering protrusion 19 of the piston shank 11. As a result of this standstill state, there is also a drop in the pressure in the hydraulic chamber of the hydraulic cylinder upstream of the piston 5, which leads to closure of the outlet valve.

In this forward end position of the piston 5 and/or of the means of action 12, the piston stroke corresponds approximately to half the piston stroke in the long-stroke position, thus, for example, 40 mm in the case of a long stroke of approximately 80 mm.

Although the adjustable stop 33 with the sleeve 34 is shown, in the exemplary embodiments illustrated, in the region of a removable device head 7, it is also quite possible for the proposed solution to be provided on pressing devices 1 of which the device head is connected in a non-releasable manner to the tool.

Figure 17:
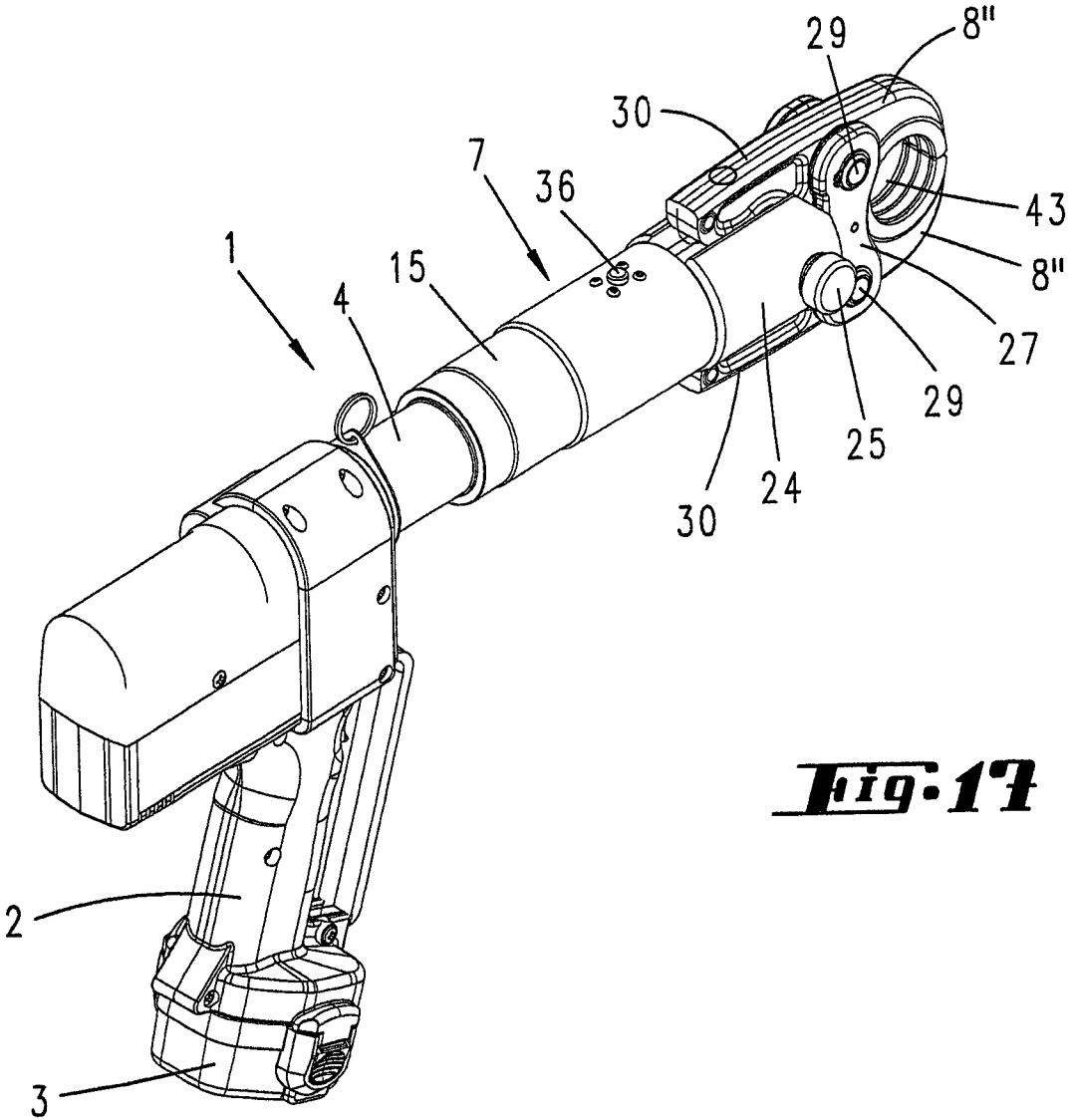
FIG. 17 shows a perspective illustration of a pressing device according to the illustration in FIG. 1, but this time relating to a second embodiment, with pressing jaws forming a pressing mouth.

It is also possible to use such an arrangement with an adjustable stop 33 in order to vary the piston stroke for pressing attachments other than the pressing chain 20 which is shown, thus, for example, in pressing jaws 8" according to FIG. 17, these pressing jaws, at the other end of the control levers 30, forming a pressing mouth 43, possibly for accommodating interchangeable pressing inserts.

Figure 18:
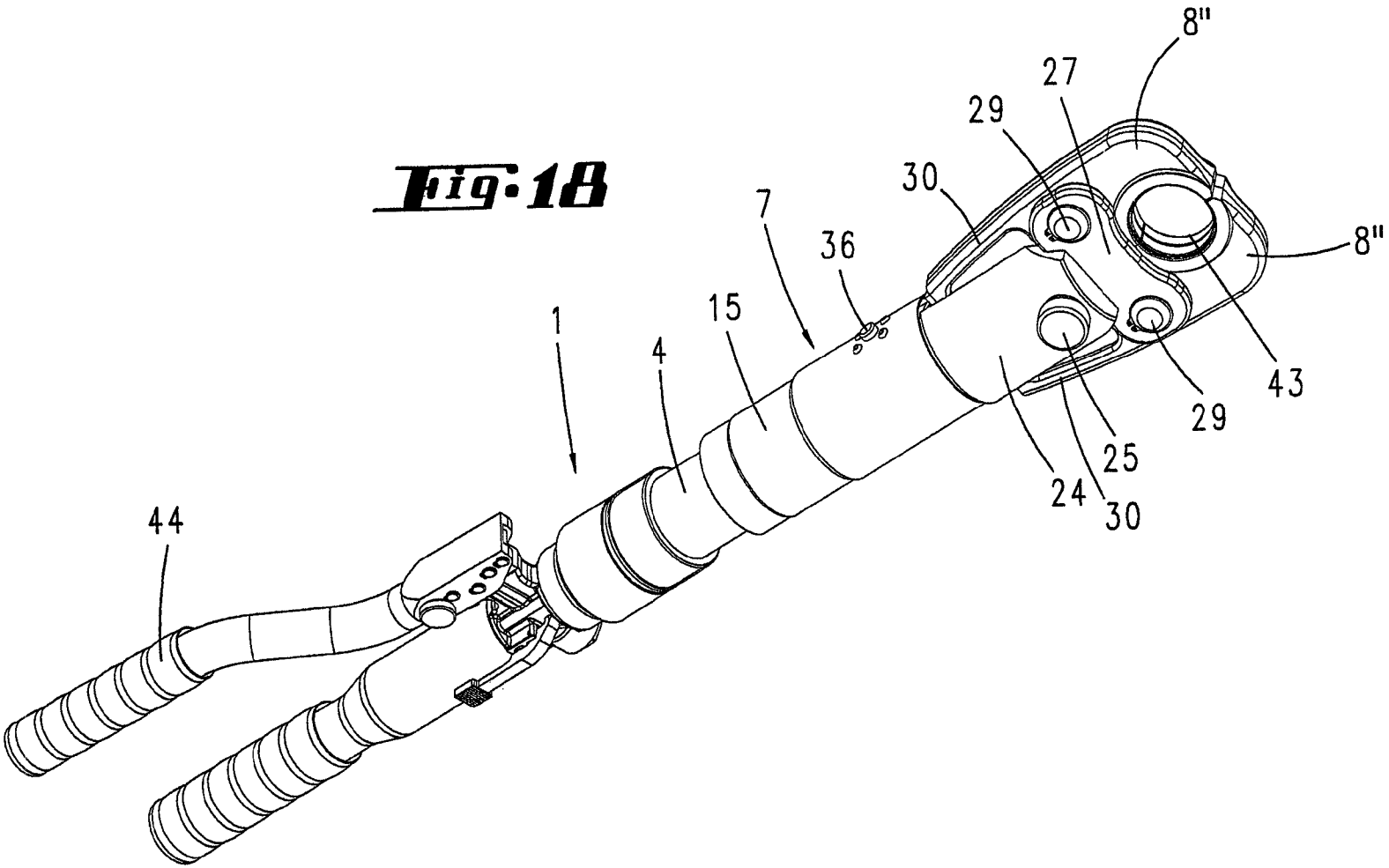
FIG. 18 shows a perspective illustration of a further embodiment of a hand-operated, hydraulically acting pressing device with an adjustable stop.

It is also possible for the proposed arrangement to be provided on a hand-operated pressing device according to FIG. 18, this being formed as a lever-actuable device. Accordingly, the pressure which is required in order to displace the piston 5 is built up by manual actuation, via a pumping lever 44, rather than by an electric motor.

Figure 19:
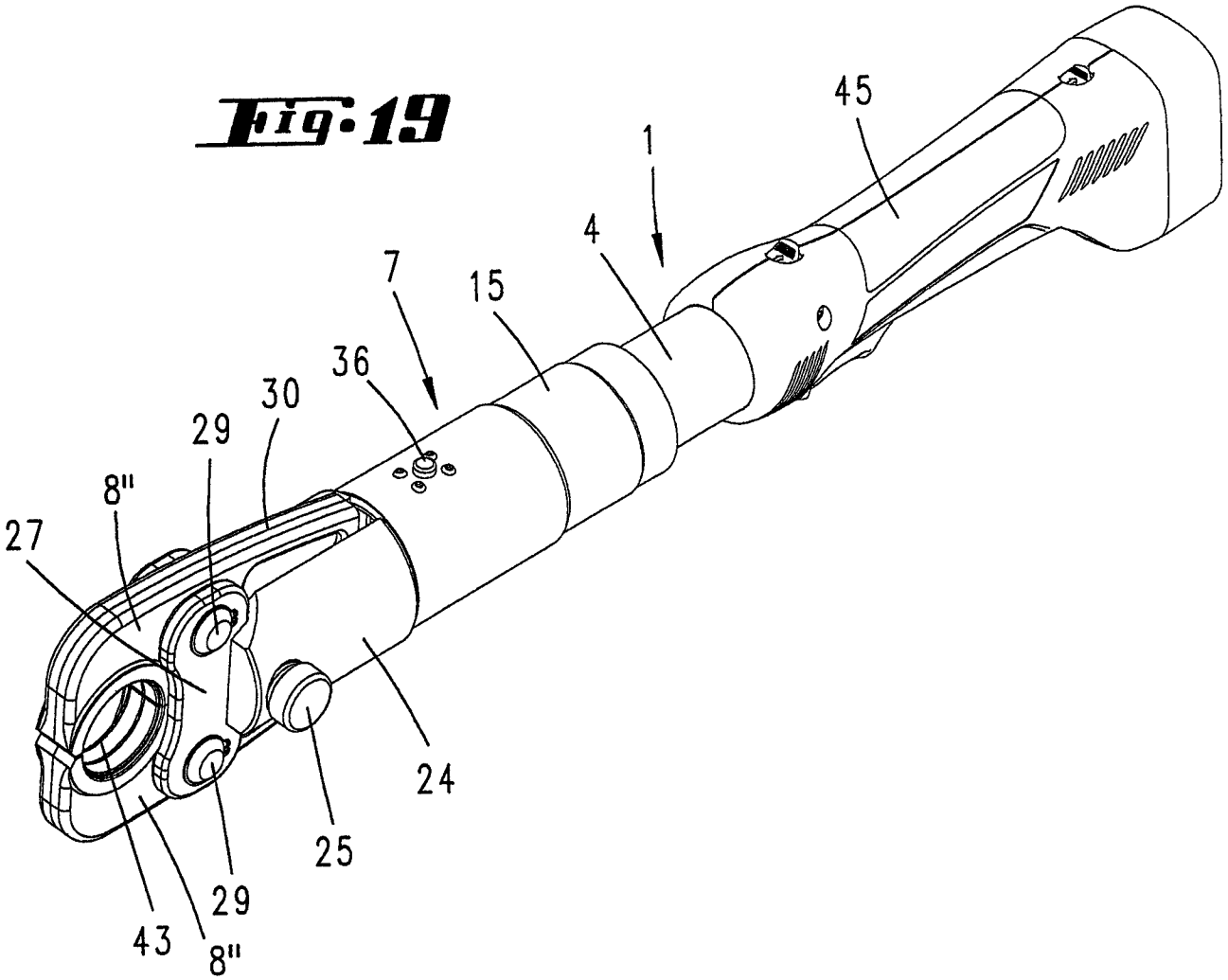
FIG. 19 shows a perspective illustration of a further embodiment of the pressing device.

It is further possible to provide the proposed arrangement on a pressing device 1 according to FIG. 19, this device being one which can be operated using one hand, and having a grip region 45 which can be enclosed by one hand and which accommodates an electric motor for hydraulic pressure activation.

Figure 14:
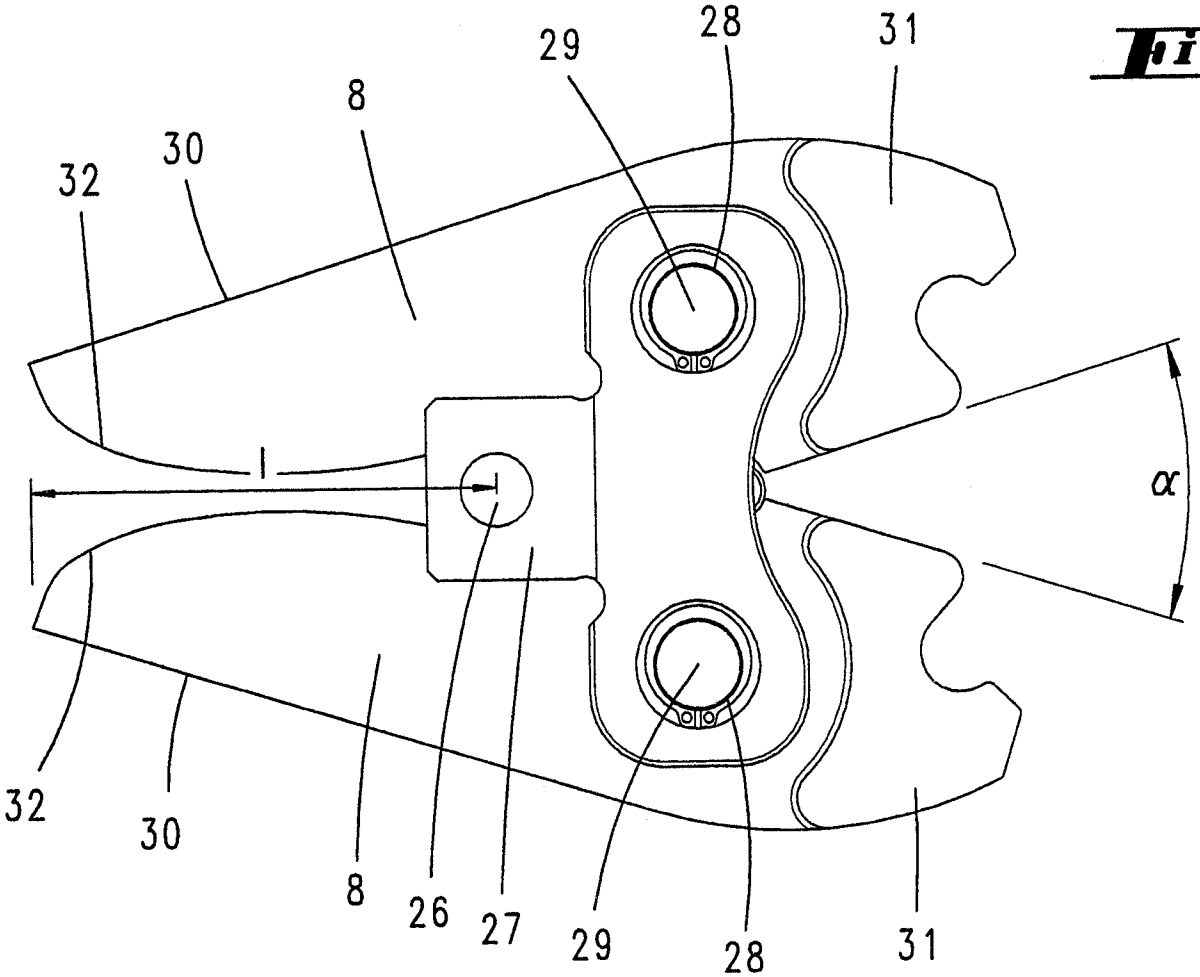
FIG. 14 shows an illustration solely of the relatively long pressing jaws.
Figure 15:
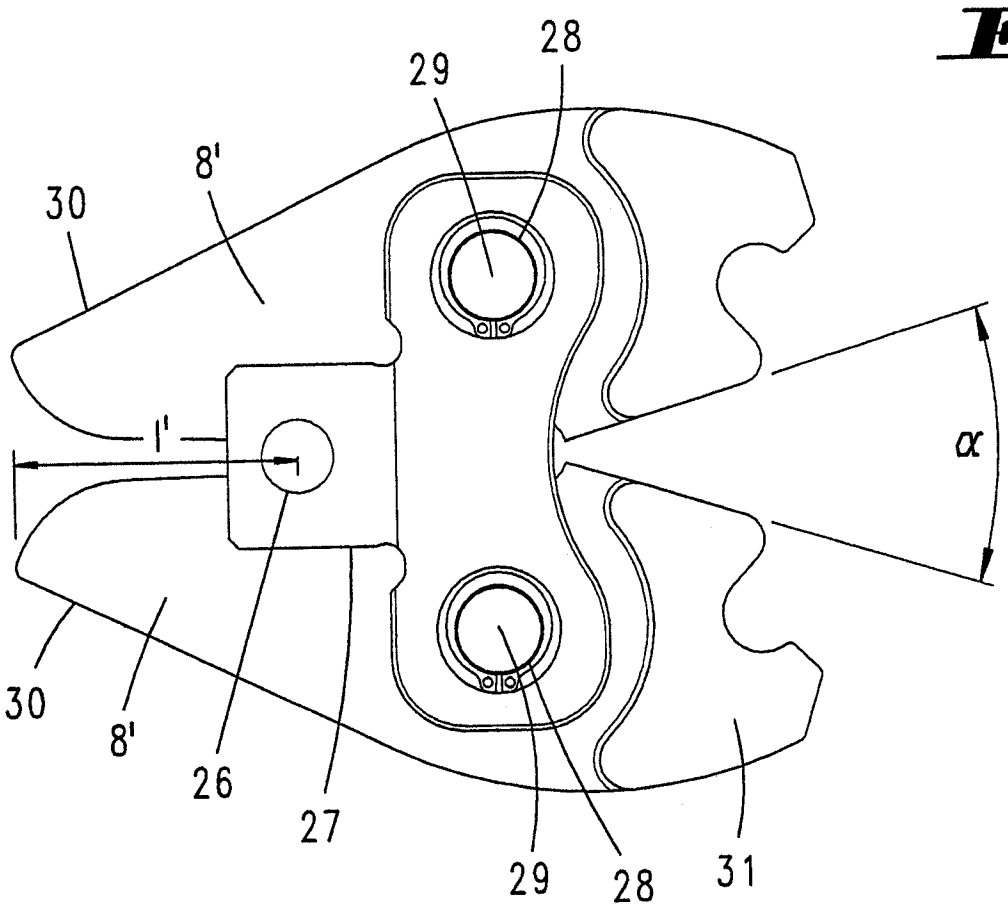
FIG. 15 shows an illustration solely of the shorter pressing jaws.
Figure 16:
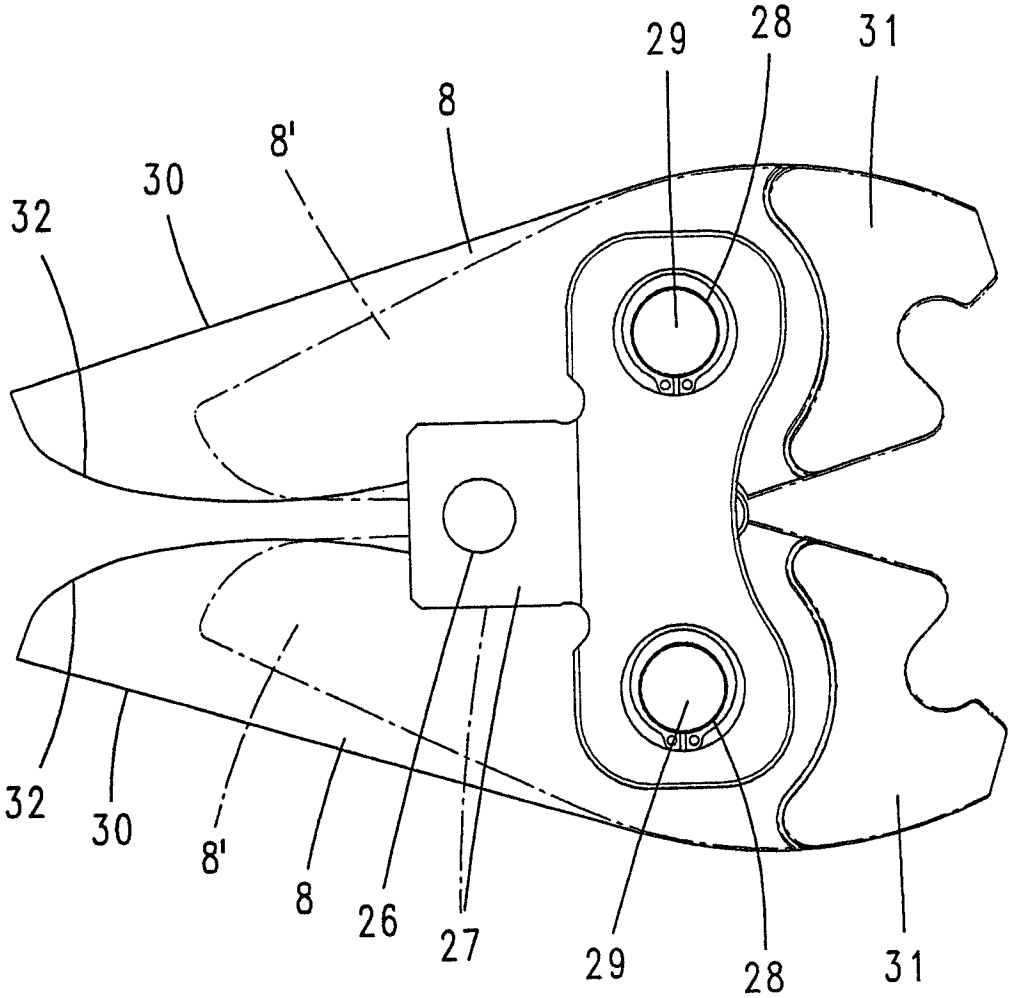
FIG. 16 shows an illustration comparing the relatively long and shorter pressing jaws.

The pressing jaws 8 and 8', which are provided with control levers 30 of different lengths, are shown on their own in FIGS. 14 and 15. FIG. 16 shows an illustration in which the different jaws are depicted in overlap with one another in order to make clear the differences in control levers, the pressing jaws 8', which have the shorter control levers 30, being represented by chain-dotted lines.

The pressing jaws 8 illustrated in FIG. 14, for activation by the means of action 12 starting from the long-stroke position, are each provided with an active control-surface length l, which is adapted to the extended piston stroke.

The corresponding length l' of the pressing jaws 8', which are formed for shorter piston-stroke activation, corresponds approximately to half the dimension 1 of the longer pressing jaws 8.

As can further be gathered from FIG. 16, the two pairs of pressing jaws 8 and 8' are formed identically in respect of their active portions, and correspondingly also have identical opening angles $\alpha$ in the rest position.

The control surfaces 32 of the control levers 30 differ in respect of their contact angles in interaction with the means of action 12. Thus, the control surfaces 32 of the extended pressing jaws 8 are curved convexly in plan view, with a radius which, starting from the free end of each control lever 30, decreases over the course of the control surface 32.

Correspondingly, activation by means of the means of action 12, in the first instance, achieves a relatively steep contact angle, in order to spread the pressing jaws 8 apart, this angle decreasing sharply, on account of the configuration of the control surfaces 32,—the configuration of the jaws 8 is such that in their starting position there is one location at which their faces are at a closest spacing; the distance between the jaws 8 tapers inwards to this point, but beyond this point, the distance between the faces increases again—, as the piston continues its forward movement and the control surfaces 32 are correspondingly subjected to the action of the rollers 13.

In the case of the shorter pressing jaws 8', in comparison with the longer pressing jaws 8—with the exception of the starting surfaces formed in the region of the free ends of the control levers 30—this contact angle is steeper over the entire path of action. In the rest position of the pressing jaws 8' according to FIG. 15, the control surfaces 32, or in plan view the peripheral edges thereof, with the exception of the starting surfaces at the ends, run more or less parallel, possibly with a tendency to form a wedge-shaped infeed in the direction of the active portions 31.

As a result of the different contact angles of the control surfaces 32, with a constant piston-pushing force, it is possible to apply different levels of pressing energy to the fitting which is to be pressed. The resulting pressing forces in the pressing mouth may differ here, for example in the case of relatively long strokes.

It may also additionally be possible, in order to alter the piston stroke, to alter the piston-pushing force, thus, for example, by adjusting the point at which the spring-activated hydraulic return-flow valve is triggered.

All features disclosed are (in themselves) pertinent to the invention. The disclosure content of the associated/attached priority document (copy of the prior application) is hereby also included in full in the disclosure of the application, also for the purpose of incorporating features of these documents in the claims of the present application.

The invention claimed is:

1. A method of pressing a fitting onto a tube comprising:

providing a hydraulic pressing device including pressing jaws, a cylinder attached to said pressing jaws, a stop, a moveable piston having a piston shank which is displaced in a displacement direction, said piston being mounted in said cylinder, and rollers connected to at least said piston shank, said rollers capable of engaging against said stop, said stop thereby limiting movement of the piston and defining a level of pressing energy, said pressing device further including a pressing chain having more than two chain links;

providing a fitting and a tube onto which said fitting is mounted; and using said rollers for acting on said pressing jaws to press said fitting onto said tube, said stop interacting with said rollers, wherein the level of pressing energy applied during a pressing operation can be changed by adjustment of the stop, and wherein for certain pressing operations, the pressing is carried out during continuous ongoing piston movement.

2. The method of claim 1, wherein said stop is manually adjusted.

3. The method of claim 2, wherein said piston is mounted in a cylinder; and said stop is manually adjusted by using a handgrip provided radially outside of the cylinder.

4. The method of claim 3, wherein the handgrip is a sleeve is displaced relative to the cylinder.

5. The method of claim 3, wherein the stop can be arrested on the cylinder as a fixed part.

6. The method of claim 1, wherein said stop is adjusted by hydraulic means.

7. The method of claim 1, wherein said stop is adjusted by electrical means.

8. The method of claim 1, wherein two or more stops are provided.

9. The method of claim 1, wherein the level of pressing energy applied during a pressing operation is between 1,000 and 4,000 joules.

10. The method of claim 1, wherein at least two pairs of different pressing jaws are provided, said at least two pairs of different pressing jaws differ in respect of a length of a region of interaction with the rollers, a relatively long region of interaction being accompanied by a relatively small angle of slope of a surface of the region of interaction which is associated with the rollers.

11. The method of claim 1, wherein said stop is mounted on said cylinder, and further including moving said stop to a first position or to a second position along the displacement direction of the piston in order for different end positions of the piston to be reached during a return movement of the piston, wherein when said piston is moved to a rearward position during the return movement, said stop, when in either said first or second positions, arrests further return movement of said piston.

* * * * *